United States Patent [19]

Berry

[11] 4,297,563

[45] Oct. 27, 1981

[54] ELECTRIC STEAM GENERATING UNIT

[76] Inventor: Clyde F. Berry, R.F.D. 7, Box 169 C, Manchester, N.H. 03104

[21] Appl. No.: 134,277

[22] Filed: Mar. 26, 1980

[51] Int. Cl.[3] ..... F22B 1/28; H05B 3/82

[52] U.S. Cl. ..... 219/275; 219/299; 219/306; 219/531; 261/142

[58] Field of Search ..... 219/271-276, 219/296-299, 302-306, 531; 261/142

[56] References Cited

U.S. PATENT DOCUMENTS

| | | | |
|---|---|---|---|
| 1,175,234 | 3/1916 | Burroughs et al. | 219/306 |
| 1,373,809 | 4/1921 | Hadaway | 219/303 X |
| 1,657,144 | 1/1928 | Armstrong | 219/299 X |
| 2,140,516 | 12/1938 | Cowan | 219/275 X |
| 2,252,541 | 8/1941 | Arnold | 219/297 X |

FOREIGN PATENT DOCUMENTS

| | | | |
|---|---|---|---|
| 882772 | 3/1943 | France | 219/306 |

*Primary Examiner*—A. Bartis

*Attorney, Agent, or Firm*—C. Yardley Chittick

[57] ABSTRACT

A electric steam generating unit includes a housing having an upper end having a steam outlet and a lower end having a water inlet. An elongated tubular electric immersion heating element is vertically disposed in the housing in such a manner that an insulator space having a closed upper end is provided between the tubular element and housing. An elongated cylindrical rod-shaped electric immersion heating element is disposed coaxially within the tubular heating element and is so dimensioned that an elongated steam generating space of small volume subjected to the heat of both elements is formed therebetween.

4 Claims, 1 Drawing Figure

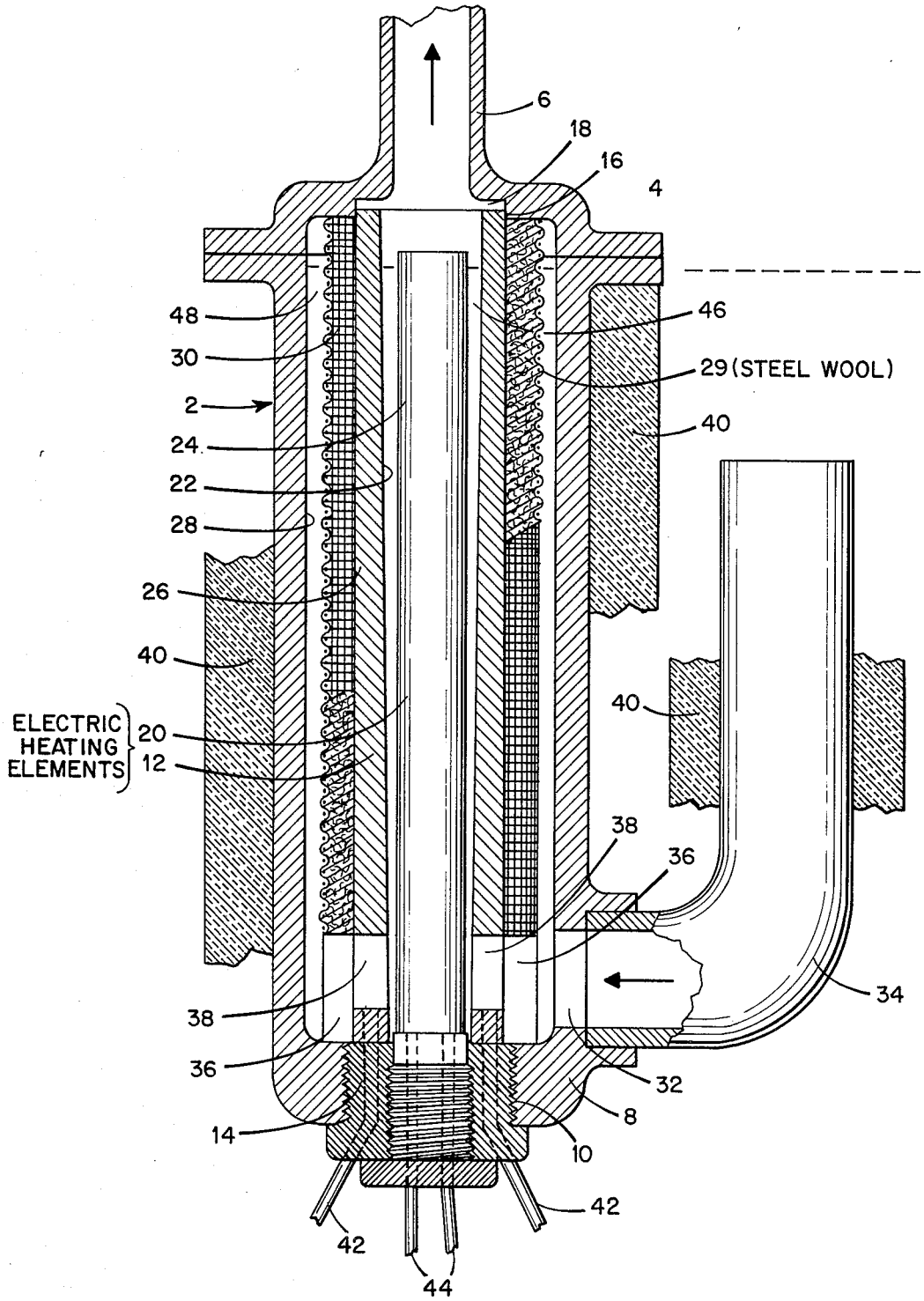
6
18
16
4
48
46
30
29 (STEEL WOOL)
2
40
24
22
28
26
40
40
ELECTRIC HEATING ELEMENTS
20
12
38
36
34
38
36
32
8
14
10
42
42
44

ELECTRIC STEAM GENERATING UNIT

BACKGROUND OF THE INVENTION

Electric heating units for heating liquids by immersion therein are old, well known and in common use for heating water in many different situations from water in a drinking glass to water in a boiler. In general however efficiency has not been great enough to induce replacement of other conventional heat sources such as oil or coal.

SUMMARY OF THE PRESENT INVENTION

The present invention contemplates the use of specially designed immersion type electric heating units so located with respect to a quantity of boiler water that the water will be fed to the units, preferably by gravity, in such limited quantity that the heat available will convert the water substantially instantly to steam. Each heating unit comprises two elements, one a long tubular element which closely surrounds a second axially positioned cylindrical element to form a cylindrical space therebetween of such small volume that the heat from the two elements is sufficient to convert the continuously arriving gravity fed water substantially instantly to steam. In the preferred form the inner wall of the long tubular element will be slightly conical with the larger end of the cone at the top so that there will be upwardly increasing space to receive the steam as it moves upward toward the steam outflow pipe. The steam by suitable piping is fed directly into the upper steam chamber of the boiler without mingling with the boiler water. The efficiency of the units disclosed herein is relatively high. The units, being encased in a housing, may be located within or outside of the boiler water container. In either case, the housing is preferably insulated from the boiler water so that the available heat is concentrated on a volume of water small enough to result in immediate generation of steam.

The invention will be better understood as the description proceeds with the aid of the accompanying drawing which shows in the single FIGURE in vertical section all of the essential elements.

DESCRIPTION OF A PREFERRED EMBODIMENT

Referring now to the drawing, the invention comprises a cylindrical vertical housing 2 closed at the top by a cover 4 from which a steam pipe 6 leads to a steam chamber (not shown) in the upper part of a water container or boiler strong enough to support the steam pressure therein.

The lower end of housing 2 has an integral closure 8 with a central threaded opening 10. Into this opening is placed a first immersion type electric heating element 12. It is fixed in position by screwing the threaded base 14 on which it is mounted into the threads 10.

Element 12 is tubular. Its upper end is held in axial position by engagement with a short circular shoulder 16 on the interior of cover 4. Vertical clearance is provided at 18 to take care of uneven expansion. The engagement of the end of element 12 with shoulder 16 effectively closes the upper end of the cylindrical space between element 12 and the housing 2.

The base 14 of element 12 has a circular threaded central opening 15 therein adapted to receive and hold in secure screw threaded connection a second immersion type electric heating element 20 in the form of a solid rod mounted on a base plug 17.

The elements 12 and 20 are preferably made to precise dimensions so that the circular space between the interior wall 22 of element 12 and the exterior surface 24 of element 20 will be of uniform radial dimension.

As shown in the drawing, the interior of element 12 is tapered with the greater diameter at the top. The diameter of element 20 is uniform throughout its length. The purpose of this construction will be explained hereinafter.

The outer surface 26 of element 12 is spaced far enough from the interior wall 28 of housing 2 to provide room for a cylindrical casing of steel wool 29 or other heat absorbing material such as small diameter steel balls held in place by a cylindrical screen 30. Element 12 radiates heat outwardly as well as inwardly but the outward radiations are absorbed by both the material 29 which is in contact with element 12 and by the relatively large volume of water in the space 48. Thus, in effect, there is a layer of insulation surrounding element 12, the temperature of which comes into equilibrium at a point not high enough to generate steam in the closed space 48.

Near the lower end of housing 2 is an opening 32 to which is connected a water supply pipe 34 through which water is fed to the interior of the housing. In order that the water may readily reach all parts of the heating apparatus, openings are provided through the screen 30 as at 36 and through element 12 as at 38. If deemed desirable, additional openings (not shown) may be provided along the length of element 12.

If the housing 2 is exterior of the boiler, then it and pipe 34 may be surrounded by insulation 40. If the unit is located in the boiler, the insulation 40 will be omitted. The opening into pipe 34 is below the boiler water level so water will be continuously supplied to the housing.

The power leads to elements 12 and 20 are indicated at 42 and 44 respectively. Wattage of 700 for element 20 and 500 for element 12 has been found to produce steam as required.

When the system is put in operation, a thin slightly conically shaped tube of water in the space 46 is subjected to heat from both elements 12 and 20. This heat is adequate to turn this small volume of water quickly to steam. The steam flows upward through the enlarging space 46 into steam pipe 6 and thence into the upper steam chamber.

As fast as the steam is being generated, water is continuously entering space 46 through the bottom openings 36 and 38, which may be in the form of vertical slits or any other desired shape, to turn into steam at the same rate. Thus, regardless of the quantity of water in the boiler, steam is being generated in a volume dependent solely upon the electric power available in the elements 12 and 20.

The water in the top closed outer space 48 between outer surface 26 and interior wall 28 becomes warm but not hot enough to turn to steam. In its warm condition, it acts as insulation to some degree thus to aid in the steam generation.

The water level in the boiler that supplies water to pipe 34 must be controlled within proper limits so that the flow to unit 2 will substantially match the steam producing capacity of elements 12 and 20.

It is intended to cover all changes and modifications of the example herein chosen for the purpose of disclosure which do not constitute departures from the spirit and scope of the invention.

I claim:

1. A steam generating unit comprising a housing having an upper end and a lower end, a first elongated tubular immersion type electric heating element within said housing and separated therefrom along its length to provide a cylindrical space, said first element at its upper end being in fluid tight engagement with said housing to close the upper end of said space, a second elongated cylindrical rod-shaped immersion type electric heating element within and coaxial with said first element, the dimensions of said elements providing therebetween a long generally cylindrical second space of which the inner surface of said first element and the outer surface of said second element comprise the walls of said second space, said second space being of such small volume that water therein when subjected to the heat of both elements will turn quickly to steam, the upper end of said second space being open to allow escape of steam from said space, a discharge port at the upper end of said housing to receive steam generated in said space, and a water inlet port into said housing and a passage therefrom to the lower end of said first and second spaces whereby water can be fed to said second space as fast as the water in said second space is being converted to steam and water may be maintained in said first space.

2. The construction set forth in claim 1, wherein said first and second heating elements are vertically disposed in said housing and the inner surface of the first heating element and the outer surface of the second heating element are so shaped that said second space over at least part of its length is of increasing volume per unit of length in an upward direction.

3. The construction set forth in claim 1, wherein said first and second heating elements are vertically disposed in said housing, the interior wall of said first element being in the form of a truncated cone with its maximum diameter being at the upper end and the exterior wall of said second element being cylindrical.

4. The construction set forth in claim 1, the water in said first space forming a layer of water insulation around said first heating element, and heat absorbing means in heat exchange contact with the said exterior of said first element and spaced from the interior of said housing.

* * * * *